US006588585B1

(12) United States Patent
Allen-Carpenter

(10) Patent No.: US 6,588,585 B1
(45) Date of Patent: Jul. 8, 2003

(54) MUSICAL PRESENTATION AND STORAGE BOX

(76) Inventor: Doris Allen-Carpenter, 3418 Freeman Rd., Durham, NC (US) 27703

( * ) Notice: Subject to any disclaimer, the term of this patent is extended or adjusted under 35 U.S.C. 154(b) by 0 days.

(21) Appl. No.: 10/295,247

(22) Filed: Nov. 15, 2002

(51) Int. Cl.[7] ..... A45C 11/04

(52) U.S. Cl. ..... 206/6.1; 206/566; 206/765; 84/94.2; 84/95.2; 84/600

(58) Field of Search ..... 206/6.1, 566, 736, 206/738, 761, 765; 84/94.2, 95.2, 600–602, 2, 3; 312/114, 237, 240; 318/16; 365/48

(56) References Cited

U.S. PATENT DOCUMENTS 2,800,048 A * 7/1957 Anderson ..... 84/95.2
3,937,320 A * 2/1976 Chao et al. ..... 206/566
5,696,333 A * 12/1997 Shih ..... 206/6.1
5,779,032 A * 7/1998 Iimura et al. ..... 206/6.1
6,026,951 A * 2/2000 Ovadia et al. ..... 206/6.1
6,361,394 B1 * 3/2002 Maida ..... 206/6.1
6,405,858 B1 * 6/2002 Gagliardi ..... 206/6.1

* cited by examiner

*Primary Examiner*—Luan K. Bui

(57) ABSTRACT

A musical presentation and storage box having a display pedestal mounted directly below a door located on the top of the box, a sound (music) module for playing various songs or spoken words, and a mechanism for presenting and storing jewelry or other objects. The device is comprised of an enclosure with an internal pedestal that can be raised and lowered by an internal mechanism comprised of a motor and a rack-and-pinion means for sequentially opening and closing the display door and raising and lowering the display pedestal. Additionally, an internal sound module is provided for playing music or speaking descriptive words while an object is displayed. An activation switch is used for displaying and/or storing the object. In use, when a button is pressed, music plays and in sequence the door opens and the pedestal rises, thereby displaying the jewelry or other object. When the button is pressed again, the pedestal lowers, the door shuts, and the music stops. The presentation box will have particular appeal on special occasions, where gifts are given and/or in retail store displays of various products.

18 Claims, 3 Drawing Sheets

MUSICAL PRESENTATION AND STORAGE BOX

BACKGROUND OF THE INVENTION

1. Field of the Invention

The present invention relates to a musical presentation and storage box for use in displaying and storing rings, bracelets, earrings, other jewelry, and other objects. The musical presentation and storage box has particular utility in connection with presenting a special gift in a novel fashion.

2. Description of the Prior Art

Jewelry boxes have long been treasured items. Not only can these be used to store and protect jewelry, but they can also play a significant role in presenting a jewelry gift to a loved one or friend.

The use of jewelry boxes is known in the prior art. For example, U.S. Pat. No. 4,882,966 to Silverman discloses musical jewelry box that plays music when the lid of the box is opened. However, the Silverman '966 patent does not raise the jewelry out of the box on a presentation pedestal in combination with playing music.

U.S. Pat. No. 2,991,876 to Shiffman discloses a display container, used to both protect and present a piece of jewelry, that tilts the jewelry piece upward for viewing as the container lid is opened. However, the Shiffman '876 patent does not raise the jewelry out of the box on a presentation pedestal in combination with playing music.

Similarly, U.S. Pat. No. 5,979,661 to Sherman et al. discloses a low profile ring display box and method for displaying jewelry, which rotates the jewelry upward for viewing as the lid of the box is opened. However, the Sherman '661 patent does not raise the jewelry out of the box on a presentation pedestal in combination with playing music.

Also, U.S. Pat. No. 4,101,023 to Schuander discloses a ring box with removable display stand, which can be used to store a ring or to display a ring on a removable stand. However, the schuander '023 patent does not raise the jewelry out of the box on a presentation pedestal in combination with playing music.

Lastly, U.S. Pat. No. D446,449 to Conway and U.S. Pat. No. 4,542,676 to Carlson et al. disclose apparatus that, may be of general interest and pertinent to the construction and design the present invention. The Conway '449 patent discloses the design for a case for rings, earrings or other articles and the Carlson '676 patent discloses an ornament assembly that is both decorative and plays music and can be hung from a Christmas tree limb or other structure. However, these patents do not disclose an apparatus that raises an object out of a jewelry box on a presentation pedestal in combination with playing music.

While the above-described devices fulfill their respective, particular objectives and requirements, the aforementioned patents do not describe a musical presentation and storage box that raises a piece of jewelry out of a jewelry box on a presentation pedestal, while in combination playing music.

Therefore, a need exists for a new and improved musical box that can be used for the presentation and storage of rings, bracelets, earring, other jewelry, and other objects. In this regard, the present invention substantially fulfills this need. In this respect, the musical presentation and storage box according to the present invention substantially departs from the conventional concepts and designs of the prior art, and in doing so provides an apparatus primarily developed for the purpose of presenting objects for viewing and storing them for protecting.

SUMMARY OF THE INVENTION

In view of the foregoing disadvantages inherent in the known types of musical jewelry boxes now present in the prior art, the present invention provides an improved musical presentation and storage box, and overcomes the above-mentioned disadvantages and drawbacks of the prior art. As such, the general purpose of the present invention, which will be described subsequently in greater detail, is to provide a new and improved presentation and storage box and method, which has all the advantages of the prior art mentioned heretofore and many novel features that result in a presentation box that is not anticipated, rendered obvious, suggested, or even implied by the prior art, either alone or in any combination thereof.

The musical presentation and storage box of the present invention has a display pedestal mounted directly below a door located on the top of the box, an sound (music) module for playing music or spoken words, and a mechanism for presenting and storing jewelry or other objects. In use, when a button (switch), located on the exterior of the box, is pressed, music plays and sequentially the door opens and the pedestal rises, thereby displaying the jewelry or other object. When the button (switch) is pressed again, the pedestal lowers, the door shuts, and the music stops. This invention will provide a novel means for presenting a special gift and the incorporated music feature can make the box a cherished keepsake. The presentation box will have particular appeal on special occasions, such as proposing, anniversaries, birthdays, presenting Christmas or other religious gifts, patriotic displays, Valentine presents, and other holidays. The invention can also be used in retail stores for displaying various products.

To attain this, the present invention essentially comprises an outer enclosure (box) that contains an internal pedestal that can be raised and lowered by an internal mechanism comprised of one or more motors and a rack-and-pinion means for opening and closing the display door and raising and lowering the display pedestal. Additionally, an internal sound (music) module is provided for playing familiar songs while the object is being displayed. A push-button switch means is provide on the outside of the box for activating the display. The display could be enhanced with a motion detector device for use in retail stores, which will present an the object to be displayed when a customer walks up.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention is to provide a new and improved musical presentation and storage box that provides in the apparatuses and methods of the prior art some of the advantages thereof, while simultaneously overcoming some of the disadvantages normally associated therewith.

It is another object of the present invention to provide a new and improved musical presentation and storage box that may be easily and efficiently manufactured and marketed.

An even further object of the present invention is to provide a new and improved musical presentation and storage box that has a low cost of manufacture with regard to both materials and labor, and which accordingly is then susceptible of low prices of sale to the consuming public, thereby making such devices economically available to the buying public.

Lastly, it is an object of the present invention to provide a new, improved, and novel method for presenting and displaying an object, such as jewelry both for personal occasions and in retail stores.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
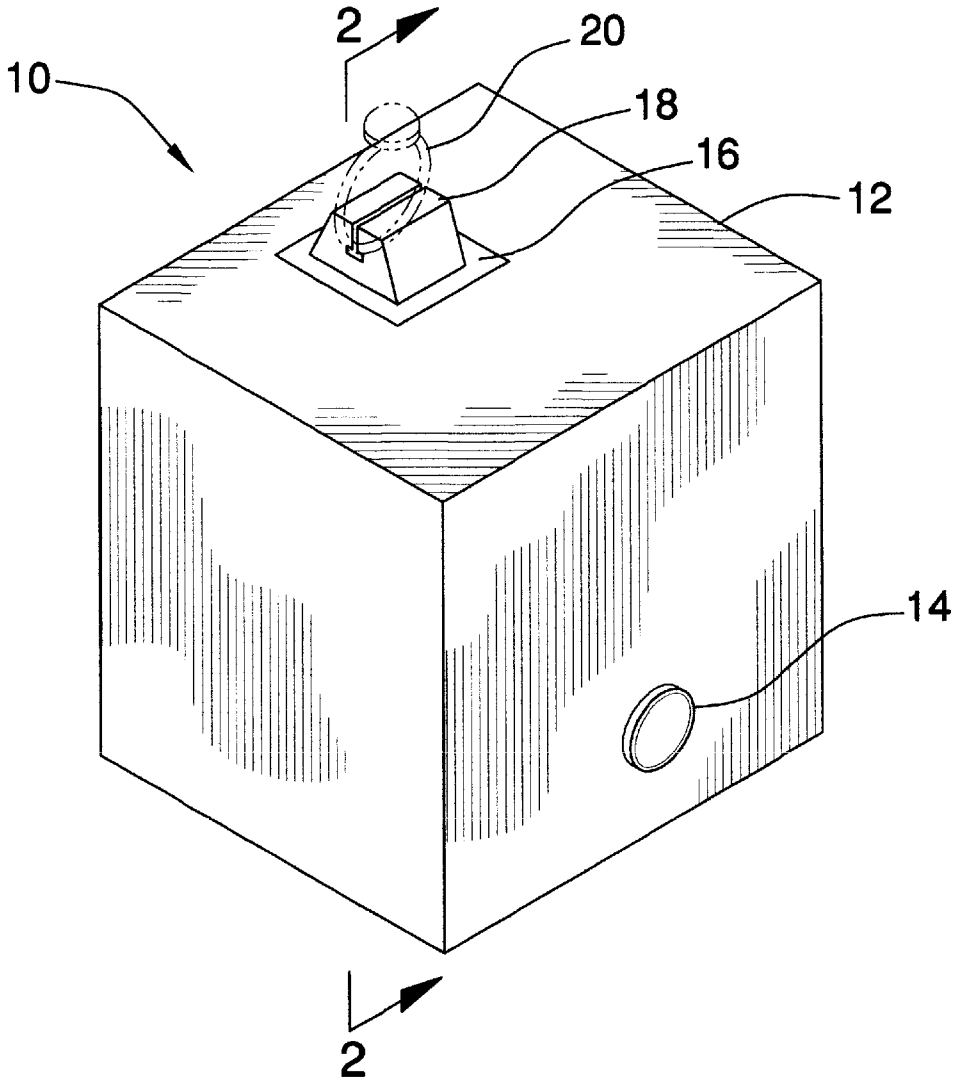
FIG. 1 is a perspective view of the preferred embodiment of the musical presentation and storage box constructed in accordance with the principles of the present invention.

Referring now to the drawings, and particularly to FIGS. 1–4, a preferred embodiment of the musical presentation and storage box of the present invention is shown and generally designated by the reference numeral 10.

In FIG. 1, the new and improved musical presentation and storage box 10 of the present invention for presenting an object in a novel manner is illustrated and will be described. More particularly, the musical presentation and storage box 10 has an outer enclosure 12 that can have practically any shape, such as a cube, a rectangle, an oval, a cylinder, and a sphere. When a push-button switch 14 located oh the exterior of the box is activated, music plays or a description of the object is spoken, a display opening 16 opens and a presentation pad 18 with a ring 20 or other object attached rises up through the display opening.

Figure 3:
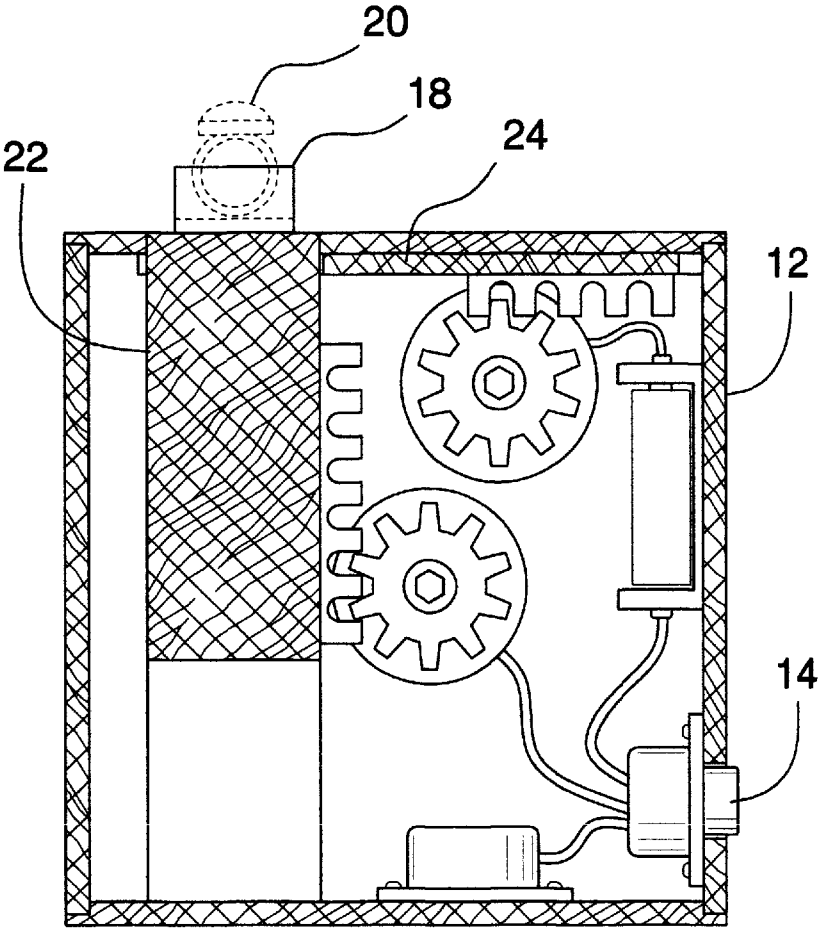
FIG. 3 is a cross-sectional side view of the musical presentation and storage box of the present invention showing a ring displayed outside the box on a raised pedestal.
Figure 2:
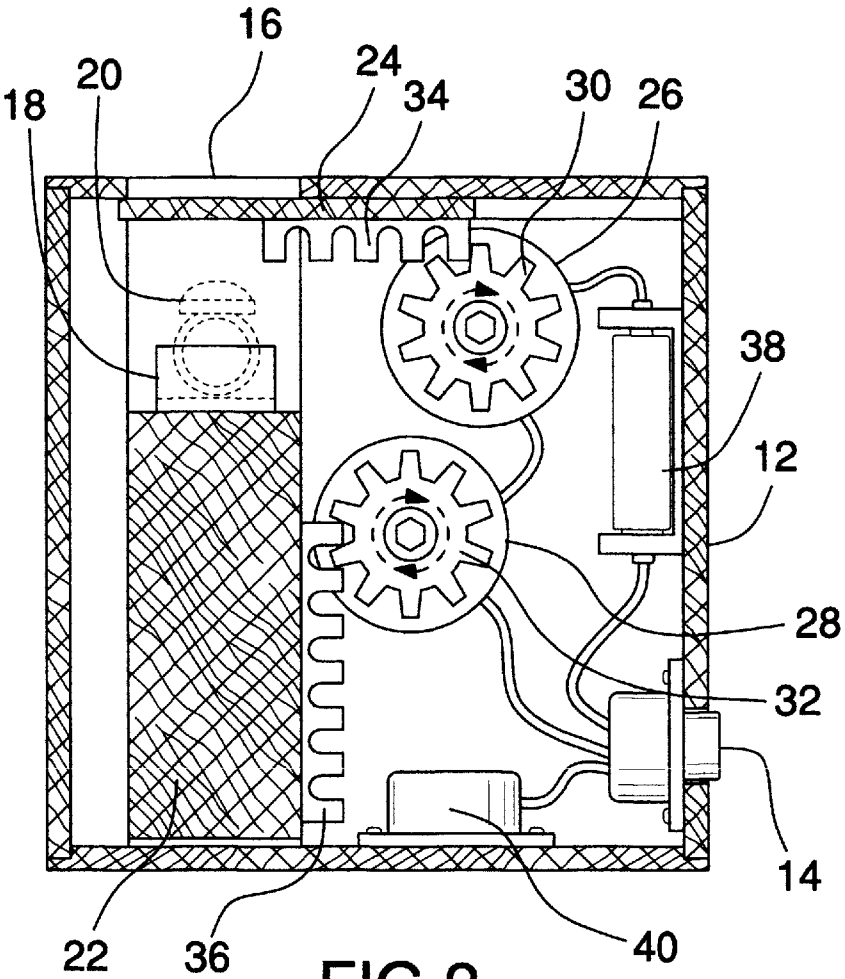
FIG. 2 is a cross-sectional side view of the musical presentation and storage box of the present invention showing a ring mounted on a display pad and stored on a lowered pedestal inside the box.

FIGS. 2 and 3, respectively, are cross-sectional side views of the musical presentation and storage box of the present invention showing the inside mechanism used to present and/or store a ring 20 or other object. More particularly, the presentation pad 18 is attached to the top of a pedestal 22 that can be raised and lowered, which sits directly below the display opening 16. A horizontal moving door 24, which can be opened and closed, slides directly below the display opening 16. The door 24 has a gear-rack 34 mounted to its bottom surface and the pedestal 22 has a gear-rack 36 mounted on one side. Two electric motors 26,28, each having a pinion-gear 30,32 attached to the motor shaft, which interface with the door and pedestal gear-racks 34,36, respectively, are used to open and close the display door 24 and raise and lower the pedestal 22. Power for the motors 26,28 is provided by a battery pack 38, also located inside the enclosure 12. Additionally, a sound (music) module 40 is included for playing music or audibly describing the displayed object. Both the motors 26,28 and the music module 40 are wired through the activation switch 14 to the battery pack 38.

Figure 4:
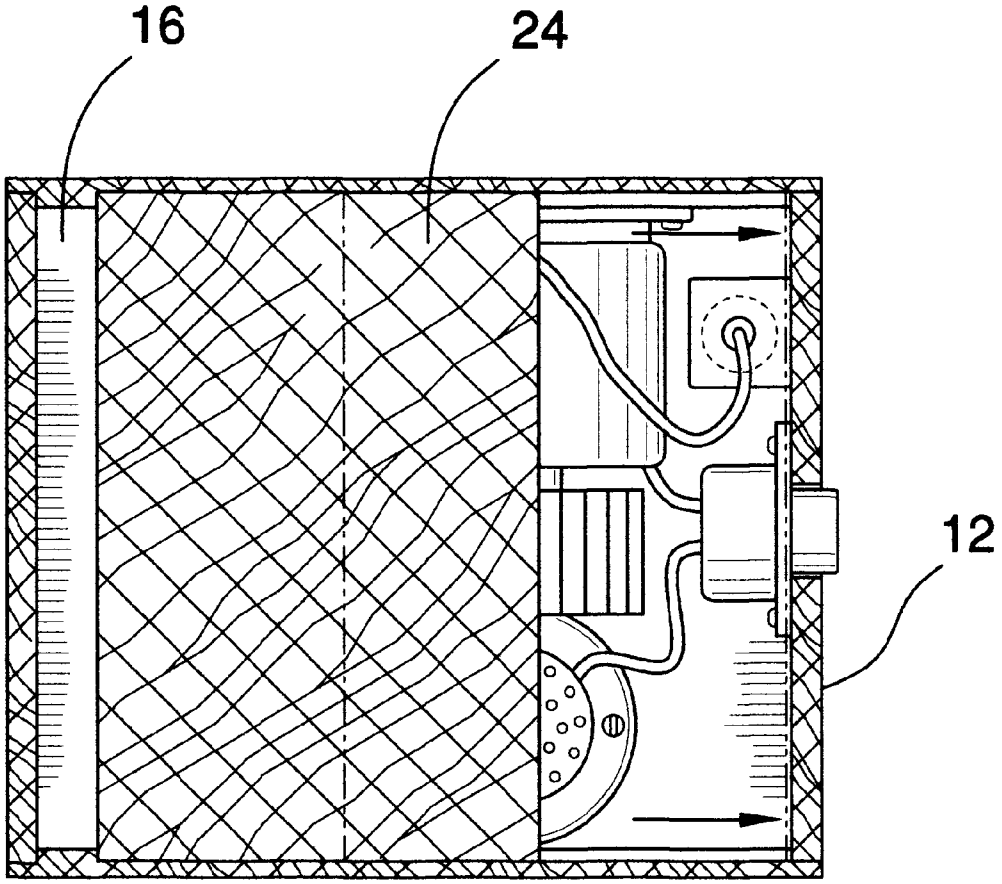
FIG. 4 is a top view of the cross-sectional side view of the musical presentation and storage box of the present invention showing the door opening for the pedestal to be raised to display the ring.

Finally, FIG. 4 is a top view of the cross-sectional side view of the musical presentation and storage box of the present invention showing the door 24 sliding open for the pedestal to be sequentially raised up through the opening 16 to display an object.

In use, it can now be understood that when a button (switch), located on the exterior of the box, is pressed, music plays and sequentially the door opens and pedestal rises, thereby displaying the jewelry or other object. When the button (switch) is pressed again, the pedestal lowers, the door shuts, and the music stops.

While a preferred embodiment of the musical presentation and storage box has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material could be used for making the outer enclosure of the device. Also, the enclosure can be decorated to be suitable for presentations on various special occasions. Furthermore, a single motor properly coupled to a rack-and-pinion mechanism, which then drives the door and pedestal, can be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A jewelry box for presenting and storing jewelry, comprising:

an enclosure, said enclosure having a bottom surface, one or more side surfaces, and a top surface, said top surface having a display opening;

a door movably mounted horizontally directly below said display opening, said door being capable of opening and closing in a horizontal position;

a pedestal movably mounting inside said enclosure further below said display opening, said pedestal being capably of being raised and lowered in the vertical direction;

a jewelry presentation pad attached to the top of said pedestal for holding said jewelry;

a first motor mounted inside said enclosure for opening and closing said door, said motor having a rotating shaft;

a second motor mounted inside said enclosure for raising and lowering said pedestal, said motor having a rotating shaft;

a first pinion-gear attached to said shaft of said first motor;

a second pinion-gear attached to said shaft of said second motor;

a first gear-rack mounted to the bottom side of said door, said first gear-rack further being coupled to said first pinion-gear;

a second gear-rack mounted to one side of said pedestal, said second gear-rack further being coupled to said second pinion-gear;

a switch mounted inside said enclosure, said switch having an activation means exposed on the exterior of said enclosure;

a music module mounted inside said enclosure for playing familiar songs; and a battery mounted inside said enclosure, said battery being wired through said switch to activate said first and second motors and said music module, thereby opening or closing said door, raising or lowering said pedestal, and turning on or off said music module.

2. The apparatus of claim 1, wherein said enclosure has a rectangular shape.

3. The apparatus of claim 1, wherein said enclosure has an oval shape.

4. The apparatus of claim 1, wherein said enclosure has a cylindrical shape.

5. The apparatus of claim 1, wherein said enclosure is fabricated from materials from the group comprising: wood, plastic, hard rubber, and sheet metal.

6. The apparatus of claim 1, wherein said motors and said sound module of said box are activated by a motion detection means for presenting said jewelry in retail stores.

7. The apparatus of claim 1, wherein said box is decorated applicably for occasions from the group consisting of: weddings, birthdays, anniversaries, patriotic themes, Christmas and other religious holidays, and Valentine's Day.

8. A device for storing and displaying objects, comprising:

an enclosure, said enclosure having a bottom surface, one or more side surfaces, and a top surface, said top surface having a display opening;

a door movably mounted horizontally directly below said display opening, a first gear-rack being attached to the bottom side of said door;

a pedestal movably mounted inside said enclosure directly below said display opening, a second gear-rack being attached to one side of said pedestal;

an object to be displayed attached to the top of said pedestal;

a motor mounted inside said enclosure for moving said door and said pedestal, said motor having a rotating shaft;

a rack-and-pinion means coupled to said rotating motor shaft;

a first pinion-gear of said rack-and-pinion means coupled to said first gear-rack mounted to said door, for opening and closing said door;

a second pinion-gear of said rack-and-pinion means coupled to said second gear-rack mounted to said pedestal, for raising and lowering said pedestal;

a switch mounted inside said enclosure, said switch having an activation means exposed on the exterior of said enclosure;

a sound module mounted inside said enclosure for providing a description of said object being displayed; and a battery mounted inside said enclosure, said battery being wired through said switch to activate said motor and said sound module, thereby opening or closing said door, raising or lowering said pedestal, and turning on or off said sound module.

9. The apparatus of claim 8, wherein said enclosure has a rectangular shape.

10. The apparatus of claim 8, wherein said enclosure has an oval shape.

11. The apparatus of claim 8, wherein said enclosure has a cylindrical shape.

12. The apparatus of claim 8, wherein said enclosure is fabricated from materials from the group consisting of: wood, plastic, hard rubber, and sheet metal.

13. The apparatus of claim 8, wherein:

a first motor having an attached first pinion-gear is attached to said first gear-rack mounted to said door; and a second motor having an attached second pinion-gear is attached to said second gear-rack mounted to said pedestal.

14. The apparatus of claim 8, wherein said motor and said sound module of said device are activated by a motion detection means for presenting and storing said objects in retail stores.

15. A method for presenting, displaying, and storing an object, comprising:

providing a device for presenting, displaying, and storing an object, said device further comprising:

an enclosure, said enclosure having a bottom surface, one or more side surfaces, and a top surface, said top surface having a display opening;

a door movably mounted horizontally directly below said display opening, said door being capable of opening and closing in a horizontal position;

a pedestal movably mounting inside said enclosure further below said display opening, said pedestal being capably of being raised and lowered in the vertical direction;

a first motor mounted inside said enclosure for opening and closing said door, said motor having a rotating shaft;

a second motor mounted inside said enclosure for raising and lowering said pedestal, said motor having a rotating shaft;

a first pinion-gear attached to said shaft of said first motor;

a second pinion-gear attached to said shaft of said second motor;

a first gear-rack mounted to the bottom side of said door, said first gear-rack further being coupled to said first pinion-gear;

a second gear-rack mounted to one side of said pedestal, said second gear-rack further being coupled to said second pinion-gear;

a switch mounted inside said enclosure, said switch having an activation means exposed on the exterior of said enclosure;

a sound module mounted inside said enclosure for providing a description of said object being displayed; and a battery mounted inside said enclosure, said battery being wired through said switch to activate said first and second motors and said music module, thereby opening or closing said door, raising or lowering said pedestal, and turning on or off said music module;

attaching an object to be displayed to the top of said pedestal;

presenting said object by activating said switch, thereby sequentially enabling said sound module, opening said door, and raising said pedestal; and storing said object by further reactivating said switch, thereby sequentially lowering said pedestal closing said door, and inhibiting said sound module.

16. The method of claim 15, wherein said enclosure is fabricated from materials from the group consisting of: wood, plastic, hard rubber, and sheet metal.

17. The method of claim 15, wherein said motors and said sound module of said device are activated by motion detection means for presenting and storing said object in retail stores.

18. The method of claim 15, wherein said device has the shape of the group consisting of: cube, rectangle, oval, cylinder, and sphere.

* * * * *